US005628715A

United States Patent [19]

Simonson

[11] Patent Number: 5,628,715

[45] Date of Patent: May 13, 1997

[54] SQUAT PRESS EXERCISE MACHINE

[75] Inventor: Roy Simonson, Colorado Springs, Colo.

[73] Assignee: CYBEX International, Inc., Ronkonkoma, N.Y.

[21] Appl. No.: 388,347

[22] Filed: Feb. 14, 1995

[51] Int. Cl.[6] ..... A63B 21/08; A63B 23/04

[52] U.S. Cl. ..... 482/97; 482/98; 482/134; 482/137

[58] Field of Search ..... 482/92–94, 97, 482/98, 133–137, 142, 148, 100

[56] References Cited

U.S. PATENT DOCUMENTS

| | | |
|---|---|---|
| D. 321,390 | 11/1991 | Jones . |
| D. 324,710 | 3/1992 | Habing . |
| 3,707,285 | 12/1972 | Martin . |
| 3,734,495 | 5/1973 | Nist et al. . |
| 3,759,511 | 9/1973 | Zinkin et al. . |
| 3,858,873 | 1/1975 | Jones . |
| 3,948,513 | 4/1976 | Pfotenhauer . |
| 3,998,454 | 12/1976 | Jones . |
| 4,149,714 | 4/1979 | Lambert, Jr. . |
| 4,169,589 | 10/1979 | McArthur . |
| 4,200,279 | 4/1980 | Lambert, Jr. . |
| 4,227,689 | 10/1980 | Keiser . |
| 4,235,437 | 11/1980 | Ruis et al. . |
| 4,298,893 | 11/1981 | Holmes . |

(List continued on next page.)

FOREIGN PATENT DOCUMENTS

| | | |
|---|---|---|
| WO80/00308 | 3/1980 | WIPO . |
| WO81/03126 | 11/1981 | WIPO . |

OTHER PUBLICATIONS

Universal Physical Conditioning Equipment Catalog, 1981–82, p. 31.

Alliance, Chattanooga Group, Inc. Flyer, Rehab Leg Press, 1994.

Cybex Div. of Lumex, Inc., "Cybex Strength Systems Modular," Brochure, p. 6, 1994.

Nautilus Sports/Medical Industries, Inc., "Machine Operating Manual: Instructions for Use, Maintenance Tips, Warranties Parts", Brochure, pp. 12, 40 & 41.

Hammer Strength, Hammer Strength Picture Price List, Oct. 1994.

Lamb Bodybuilding Machines, "Four–Bar Heavy–Duty Plate–Loaded Variable–Resistance Bodybuilding Machines", Brochure, p. 1.

Loredan Biomedical, Inc., "Lido Loredan, A New Vision of Strength Training", Brochure, pp. 1, 14, 15 & 17, 1990.

(List continued on next page.)

*Primary Examiner*—Richard J. Apley
*Assistant Examiner*—Victor K. Hwang

[57] ABSTRACT

An apparatus and a method for performing a squat press exercise are disclosed. A user support, such as a seat and a backrest, is mounted to a frame. A four-bar linkage is mounted to the frame distal to the user support. A footplate is mounted to the four-bar linkage. A lever is mounted to the four-bar linkage and is adapted to support removable weight plates. As the user presses the footplate, the four-bar linkage rotates, controlling the orientation of the footplate such that the footplate does not rotate with respect to the user support (and, thus, the user). The lever also rotates, causing the weight plates to lift in an arcuate path, thereby providing an increasing resistance to the movement of the footplate during the concentric portion of the exercise. In accord with another aspect of the invention, a method is provided for exercising the legs and lower torso. A weight resistance is selected. A user is supported on a user support and places her feet on a footplate. The user then pushes her feet against the footplate, displacing the footplate and causing a four-bar linkage to rotate. A lever connected to the four-bar linkage is caused to rotate, thereby lifting a weight attached to the lever through an arcuate path and presenting an increasing resistance to the movement of the footplate during the concentric portion of the exercise.

33 Claims, 3 Drawing Sheets

U.S. PATENT DOCUMENTS

| | | | |
|---|---|---|---|
| 4,314,697 | 2/1982 | Brumfield et al. . | |
| 4,341,380 | 7/1982 | Sauder . | |
| 4,357,010 | 11/1982 | Telle . | |
| 4,357,011 | 11/1982 | Voris | 482/98 |
| 4,358,105 | 11/1982 | Sweeney, Jr. . | |
| 4,411,424 | 10/1983 | Barnett . | |
| 4,465,274 | 8/1984 | Davenport . | |
| 4,470,597 | 9/1984 | McFee . | |
| 4,482,152 | 11/1984 | Wolff . | |
| 4,502,681 | 3/1985 | Blomqvist . | |
| 4,511,137 | 4/1985 | Jones . | |
| 4,555,108 | 11/1985 | Monteiro . | |
| 4,645,197 | 2/1987 | McFee . | |
| 4,684,126 | 8/1987 | Dalebout et al. . | |
| 4,807,877 | 2/1989 | Buxton . | |
| 4,822,038 | 4/1989 | Maag | 482/97 |
| 4,828,254 | 5/1989 | Maag | 482/97 |
| 4,872,670 | 10/1989 | Nichols | 482/97 |
| 4,915,378 | 4/1990 | Abrahamian et al. . | |
| 5,000,446 | 3/1991 | Sarno . | |
| 5,058,888 | 10/1991 | Walker et al. . | |
| 5,066,003 | 11/1991 | Jones . | |
| 5,066,004 | 11/1991 | Jones . | |
| 5,078,152 | 1/1992 | Bond et al. . | |
| 5,106,080 | 4/1992 | Jones . | |
| 5,106,081 | 4/1992 | Webb . | |
| 5,108,095 | 4/1992 | Nichols . | |
| 5,116,297 | 5/1992 | Stonecipher | 482/97 |
| 5,152,733 | 10/1992 | Farenholtz et al. . | |
| 5,209,715 | 5/1993 | Walker et al. . | |
| 5,244,441 | 9/1993 | Dempster et al. . | |
| 5,254,067 | 10/1993 | Habing et al. . | |
| 5,263,914 | 11/1993 | Simonson et al. . | |
| 5,314,390 | 5/1994 | Westing et al. . | |
| 5,336,148 | 8/1994 | Ish, III | 482/98 |
| 5,366,432 | 11/1994 | Habing et al. . | |
| 5,437,589 | 8/1995 | Habing | 482/100 |
| 5,484,365 | 1/1996 | Jones et al. | 482/97 |

OTHER PUBLICATIONS

Cybex Div. of Lumex, Inc., "Eagle Fitness Systems by Cybex," Brochure, p. 25.

Cybex Div. of Lumex, Inc., "Eagle Performance Systems, The New Standard of Excellence," Brochure, p. 9.

Cybex Div. of Lumex, Inc., "Cybex Strength Systems, A Body of Work", Brochure, 1989/1990.

Cybex Div. of Lumex, Inc., "Cybex Strength Systems, A Body of Work" (VR), Brochure, 1989/1990.

Cybex Div. of Lumex, Inc., "Cybex Strength Systems", Service and Parts Manual, p. 29, 1992.

Cybex Div. of Lumex, Inc., "Cybex Strength Systems", Brochure, pp. IV–10, V–14 & V–15, 1993.

Cybex Div. of Lumex, Inc., "Cybex Strength Systems Owner's Manual", pp. 8, 10, 11 & 12, Brochure.

Cybex Div. of Lumex, Inc., "Cybex Extremity Systems, The Cybex 6000 Extremity System", Brochure, 1991.

Cybex Div. of Lumex, Inc., "Fastex Exclusively From Cybex", Brochure, Jun. 1994.

Cybex Div. of Lumex, Inc., "Medical Strength Systems", Brochure, pp. 1 & 6, 1993.

Cybex Div. of Lumex, Inc., "Cybex Testing and Rehabilitation Systems", Brochure, 1993.

Cybex Div. of Lumex, Inc., "Cybex Strength Systems", Brochure, 1993.

Nautilus Sports/Medical Industries, Inc., "Leverage Machines by Nautilus Instruction Manual", Brochure, p. 5.

Nautilus Sports/Medical Industries, Inc., "Nautilus Instruction Manual", Brochure, pp. 8 & 14, 1980.

Nautilus Sports/Medical Industries, Inc., "Nautilus Midwest New Products", Brochure.

Atlantic Fitness Products, "Specialists In Physical Fitness and Health Equipment", Brochure, 1985.

Bodymasters, "Expect The Best", Brochure.

Bodymasters, Brochure, p. 28 et sec.

The Ariel Computerized Exercise System: "CES 5000 Arm–Leg", Brochure.

"Muscle Dynamics, Maxicam by Muscle Dynamics Product Listing", Brochure.

Universal Gym Equipment, Inc., "Universal Conditioning Machines and Free Weights", Brochure.

Delorme, Captain Thomas L., "Restoration of Muscle Power by Heavy–Resistance Exercises", The Journal of Bone and Joint Surgery, vol. XXVII at 645, 660 (1945).

Athletic Journal, vol. 59, No. 2, Oct. 1978, Advertisements.

SQUAT PRESS EXERCISE MACHINE

FIELD OF THE INVENTION

The invention relates to the field of exercise and physical rehabilitation equipment, in particular, to an apparatus for exercising the legs and lower torso.

BACKGROUND OF THE INVENTION

It is often necessary or desirable for a person to exercise a particular muscle or group of muscles. For example, when a muscle is damaged, such as through injury or surgery, it is important to exercise the muscle to prevent atrophy and to strengthen the muscle for normal use. Further, people exercise healthy muscles to increase strength and to maintain an active and healthy lifestyle, as well as to improve their appearance. Various routines have been developed to exercise different muscles groups by forcing the muscles to contract and extend under a load, such as by moving a free weight against the force of gravity or by moving a pad or a sled whose movement is resisted by an exercise machine.

One exercise that has been developed to exercise the legs and lower torso is known as the squat. The exerciser typically rests a weighted bar on his shoulders. The exerciser then bends his legs (i.e., "squats") to lower the weight (eccentric action) and stands straight to lift the weight (concentric action). This exercise can be dangerous since the exerciser may lose his balance and fall. Further, this exercise can strain the back as the spine will be subject to substantial loads when fully exercising the legs. Another drawback to squats is that they require a partner since they should be done only with a "spotter" to help lift the weight if the exerciser fails. Furthermore, when performing a traditional squat, the weight resistance is constant over the entire exercise stroke. However, the leg muscles have varying strength over the range of motion. Consequently, the muscles are not subject to maximum load over the complete range of motion.

To overcome these disadvantages, machines have been developed to simulate the squat. In one machine, known as a hack squat, a sled is slidingly mounted to a frame at an angle, such as 45° from horizontal. Weight posts, adapted to support free weights, are attached to the sled. The user, once positioned on the sled, exercises by bending and straightening her legs, thereby moving the sled and any weights mounted thereon under the force of gravity. Similar to traditional squats with a barbell, the weight resistance is constant during the exercise stroke. Further, some sort of linear bearings or rollers are required to permit the movement of the sled. Such bearings can have a shorter life than rotational bearings.

In another such machine marketed by the assignee of the instant application, a rail-mounted sled is engaged to a weight stack via a cable and pulley system. The user lies on the sled in a squatting position with his feet on a foot platform. As the user attempts to straighten his legs, the sled moves along the rails, pulling the cable and lifting the weight stack. The user exercises his legs by overcoming the force of gravity on the weight stack. The force resisting the movement of the sled can be changed over the range of motion by implementing an eccentric cam as part of the pulley system. While effective at exercising the legs over the full range of motion, such a machine can be more costly to manufacture and ship because the weight stack is included with the machine.

In another machine, disclosed in U.S. Pat. No. 5,263,914, a leg press machine is provided that has a four-bar linkage to control the movement of a footboard. A linkage mechanism connects the four-bar linkage to a cable and pulley system attached to a weight. As the user presses on the footboard, the four-bar linkage moves the linkage mechanism which, in turn, pulls the cable and lifts the weight. This machine also requires that the weight stack be manufactured and shipped with the machine. Further, the linkage mechanism includes a cable, pulley and lever combination which will require regular, time-consuming maintenance.

In another machine, disclosed in U.S. Pat. No. 5,366,432, a leg press machine is provided that has a four-bar linkage to control the movement of a pushplate. The four-bar linkage is connected to a weight stack by a cable and a series of pulleys. The exercise pushes the pushplate with her feet, rotating the four-bar linkage and lifting the weight. This machine also requires that the weight stack be manufactured and shipped with the machine. Further, the cable and series of pulleys will require regular, time-consuming maintenance.

In another machine, disclosed in U.S. Pat. No. 5,106,080, levers are pivotally mounted to a frame above a seat. Footpads are mounted to each lever. Weight posts, adapted to support removable weight plates, are mounted to each lever. The user exercises by pushing the footpads with his foot, causing the levers to rotate and displacing the weight. The user's foot travels in an arcuate path that is concave up. While this machine is not manufactured or shipped with its own weights, the user's foot exerts force in this unnatural, concave up motion.

SUMMARY OF THE INVENTION

In accord with one aspect of the present invention, a squat press machine is provided in which a user support, such as a seat and a backrest, is mounted to a frame. A four-bar linkage is mounted to the frame distal to the user support. A footplate is mounted to the four-bar linkage. A lever is mounted to the four-bar linkage and is adapted to support removable weight plates. As the user presses the footplate, the four-bar linkage rotates, controlling the orientation of the footplate such that the footplate does not rotate with respect to the user support (and, thus, the user). The lever also rotates, causing the weight plates to lift, thereby providing an increasing resistance to the movement of the footplate during the concentric portion of the exercise.

In accord with another aspect of the invention, a method is provided for exercising the legs and lower torso. A weight resistance is selected. A user is supported on a user support and places her feet on a footplate. The user then pushes her feet against the footplate, displacing the footplate and causing a four-bar linkage to rotate. A lever connected to the four-bar linkage is caused to rotate, thereby lifting a weight attached to the lever through an arcuate path and presenting an increasing resistance to the movement of the footplate during the concentric portion of the exercise.

DETAILED DESCRIPTION OF THE DRAWINGS

Figure 1:
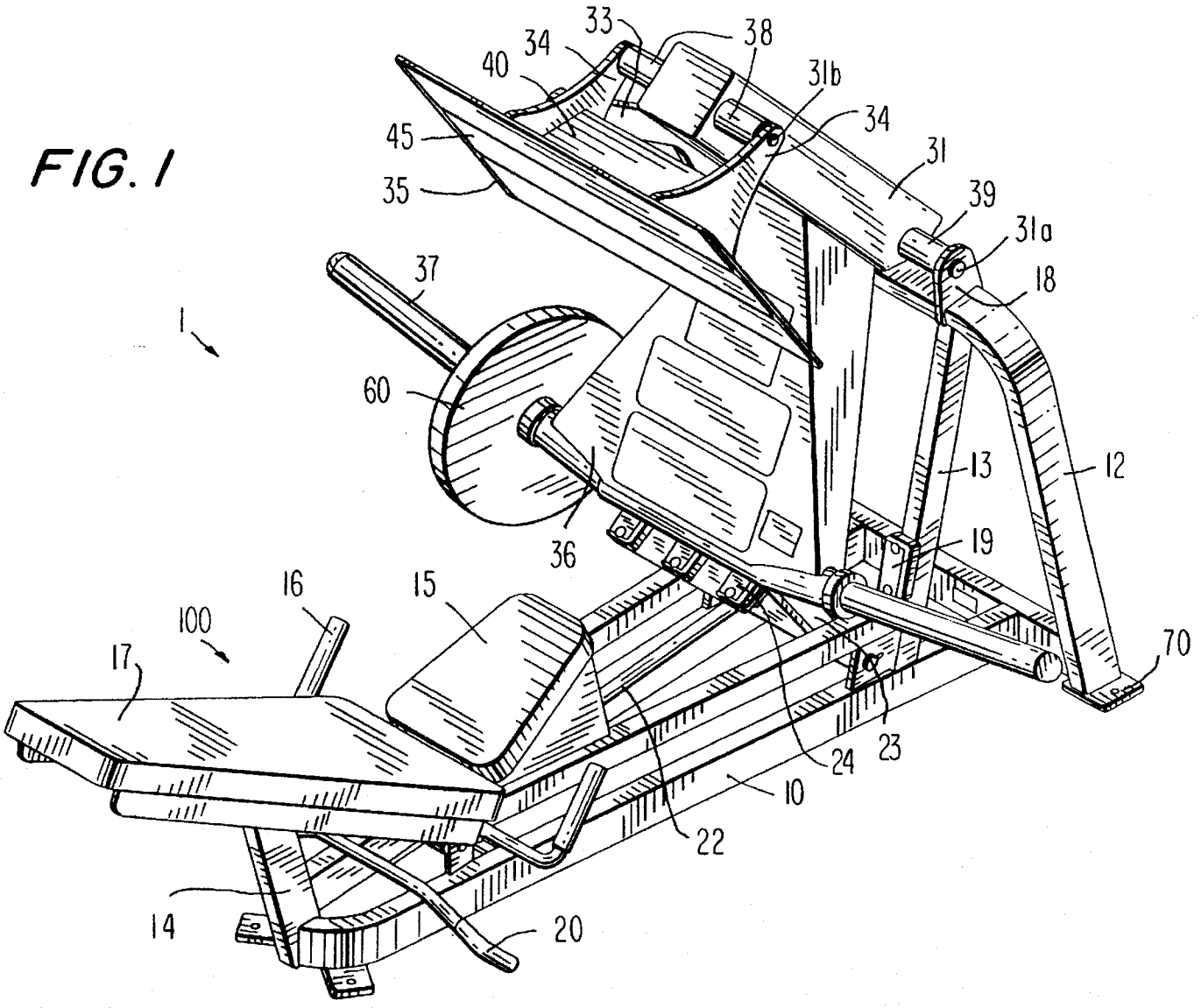
FIG. 1 is a perspective view from the rear of a squat press machine of an embodiment of the invention.

FIG. 1 is a perspective view from the rear of a squat press machine 1 of an embodiment of this invention. A seat 15 and backrest 17 are mounted to a frame 10, forming a user support 100. Handles 16 are rigidly mounted to the frame on each side of the seat. The backrest is attached to the frame by a backrest support 14. As currently preferred, the seat and the backrest are not adjustable. However, the backrest may be rotatably mounted to the frame such that the backrest can be articulated with respect to the seat. The backrest support could be adjustable to maintain the backrest at various orientations. Further, the entire user support may be mounted on a slide such that its location on the frame can be adjusted as well. The handles also could be adjustable to increase user comfort. However, these features are not necessary to exercise effectively with this machine.

A footplate 35 is attached to footplate mounts 34, such as by welding. The footplate may have a roughened surface or a non-slipping material 45 applied to the surface to prevent a user's feet from slipping. A web 40 is attached, such as by welding, to the mounts and the footplate for added stability. The mounts are rotatably mounted to a beam 31 by tubes 38. Bearings or bushings (not shown) mounted inside the tubes 38 permit the mounts 34 (and, thus, the footplate 35) to rotate with respect to the beam. The beam is rotatably mounted to the frame by tubes 39, flange 18, and lower link 30 (see FIG. 3). Again, bearings or bushings mounted inside the tubes 39 are used to permit the tubes to rotate with respect to the flange 18 and lower link 30.

An arch 12 is mounted to the frame 10 opposite the user support 100. Buttresses 13 (see FIG. 3) are mounted to the frame and the arch such that the frame, arch and buttresses create a truss. The flange 18 is rigidly mounted to the arch at the top of the truss. As currently preferred, the pivot 31*a* (see FIG. 2) for the beam 31 is disposed above the user support 100 and the footplate 35 is disposed above the seat 15. However, other orientations may be employed and still practice the invention. Preferably, the footplate is disposed above the pivot 31*a* such that the path of the footplate is concave down.

A lever 36 is attached rigidly to beam 31, such as by welding. Preferably, the lever is shaped substantially like a triangle having an apex and a base as viewed from above. The apex of the triangle is attached to the beam. Posts 37 that are adapted to support removable weight plates are mounted to the lever at the base of the triangle distal to the beam. Preferably, the posts are displaced from the center of the squat press machine 1 such that the weight plates will not contact the user during exercise as the lever rotates about the frame. Further, the posts preferably are disposed at about the height of a typical user's waist, and protrude outside the frame of the machine, for convenient mounting of the weight plates. Of course, the lever could have a different design and the weight plates could be located elsewhere and still practice the invention. A weight plate 60 is shown mounted on one post. Preferably, the weight mounted on each post during exercise is the same.

Figure 2:
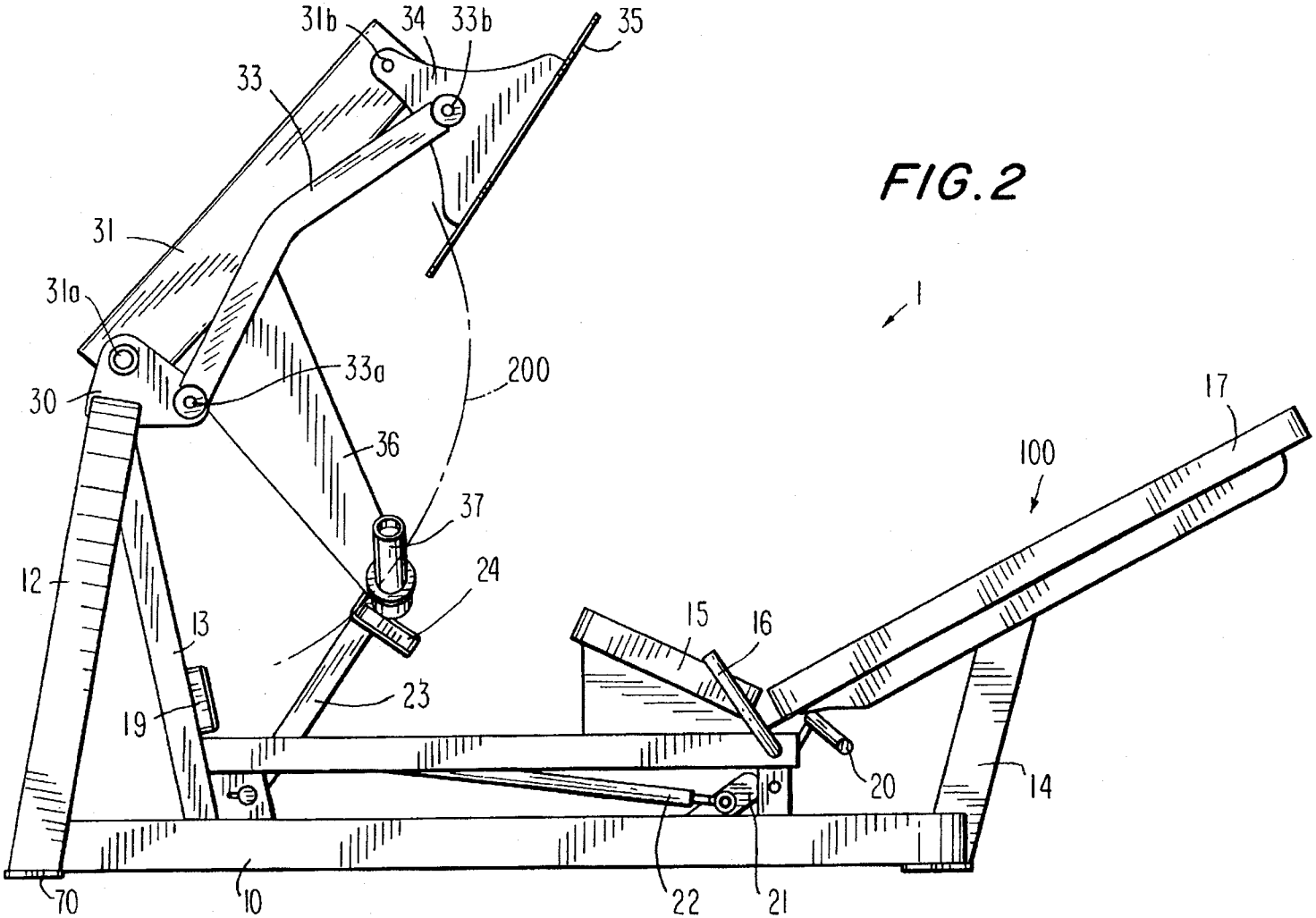
FIG. 2 is a side elevational view of the squat press machine of FIG. 1.

FIG. 2 is an elevational side view of the squat press machine 1 of FIG. 1. A lower link 30 is mounted rigidly to the top of the arch. The beam 31 is pivotally mounted to the lower link. An upper link 33 is pivotally mounted to the lower link and the footplate mount 34. The upper link 33 is bent in at the center to reduce the envelope occupied by the four-bar linkage. The lower link, the beam, the footplate mount and the upper link form a four-bar linkage that controls the translation of the footplate. The distances between the pivots 31*a*, 31*b* on the beam is greater than the distance between the pivots 33*a*, 33*b* on the upper linkage. Consequently, the footplate rotates downward as it is translated in an arcuate path about the frame 10. The angular orientation of the footplate to the user's lower leg thus remains substantially constant as the user's knee is straightened.

A stop 23 is rotatably mounted to the frame 10. As seen in FIG. 2, the range of movement of the machine may be limited by rotating the stop into the path of the lever 36, thereby preventing the lever and, thus, the four-bar linkage and footplate 35, from rotating further. In this way, the stop operates to hold the footplate in an intermediate position to allow a user easy access and egress from the user support 100. Bumpers 24 may be placed on the stop to cushion the contact with the lever. A stop release 20 is rotatably mounted to the frame. Tab 21 is rigidly mounted to the stop release. Rod 22 is rotatably mounted to the tab and the stop 23. As discussed further below, the stop, rod, tab and stop release cooperate to permit a user to rotate the stop out of the path of the lever. A pad 19 is mounted to the buttress 13 to prevent the lever from hitting the frame if the footplate is lowered completely by the user without engaging the stop.

Figure 3:
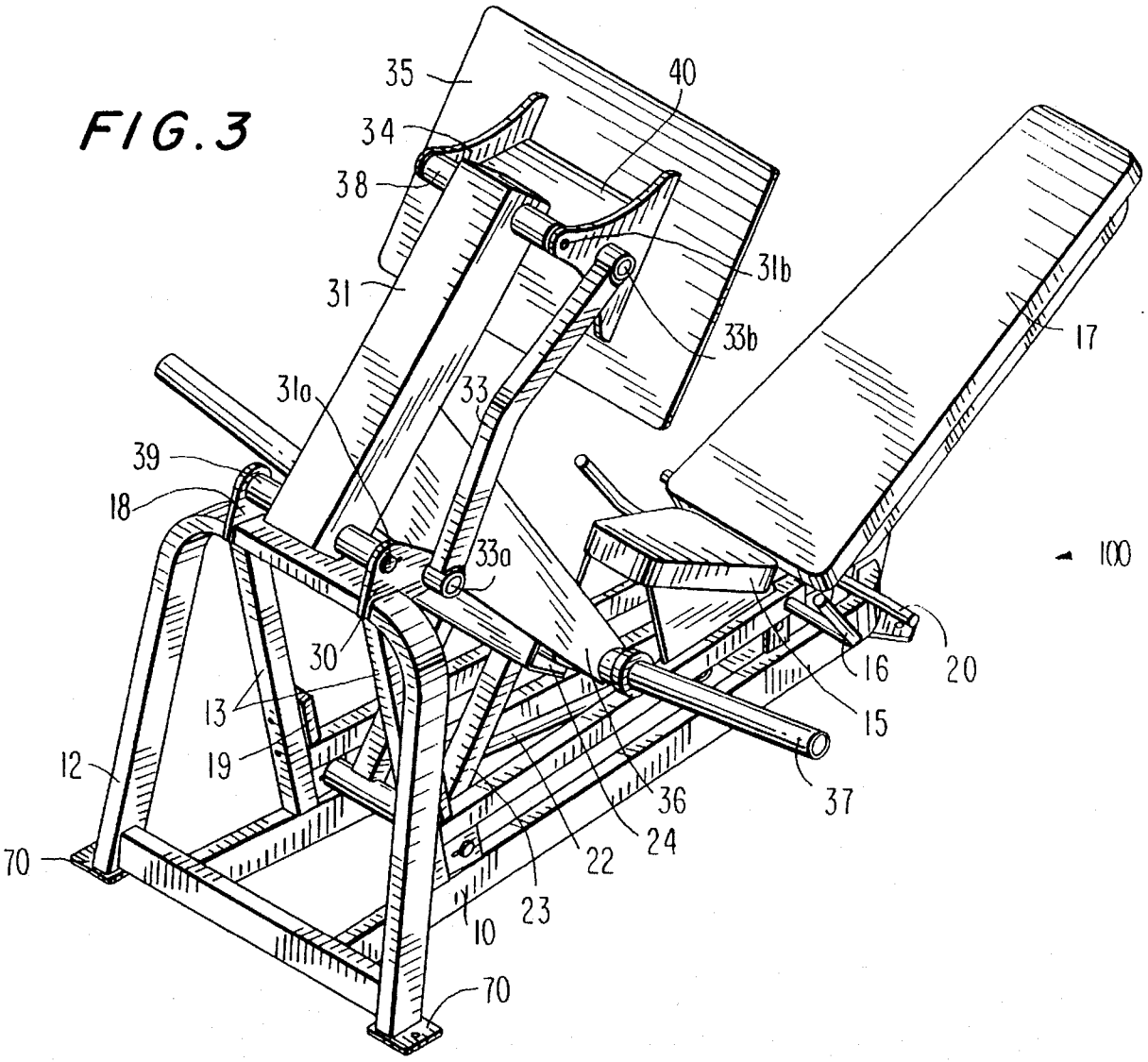
FIG. 3 is a perspective view from the front of the squat press machine of FIG. 1.

FIG. 3 is a perspective view from the front of the squat press machine of FIG. 1. As currently preferred, the upper link 33 is mounted only to one side of the frame, although another link could be added to the other side and still practice the invention. As currently preferred, only one footplate 35 is provided for both feet. However, two footplates could be employed to permit independent foot movement, each footplate having its distinct four-bar linkage, lever, weight post or stop. The distinct four-bar linkages could be rotated or displaced with respect to the user support 100 to vary the load on the user's muscles. For example, the four-bar linkages could be displaced laterally and rotated such that the footplates will move radially with respect to the user support. Consequently, the user will be required to push the footplate outward laterally, as well as away from the user support, during exercise.

As seen in FIGS. 1 and 3, the footprint of the frame 10 is roughly triangular. This provides the wide base necessary for stability at the foot of the machine 1 while minimizing the total space taken up by the machine. Feet 70 are disposed at the bottom of the frame and are adapted to mount the machine to the floor of a gym, if so desired.

To operate the squat press machine 1, the user loads weight plates 60 onto the posts 37. The user then sits on the seat 15 and lies back against the backrest 17. Entrance to the seat is facilitated because the footplate 35 is held in an intermediate position by the stop 23. If the seat and backrest were adjustable, they could be adjusted at this point. The user places her feet on the footplate in a comfortable position and presses the footplate away from her body. Moving the footplate causes the lever 36 to rotate up, off the stop. Further, any weights mounted on the lever are also lifted. Once the lever is lifted off the stop, the user pushes down on the stop release 20. The movement of the stop release causes the tab 21 to push the rod 20 which, in turn, pushes the stop, thereby rotating the stop out of the path of the lever 36.

Once the stop 23 is out of the path of the lever 36, the lever and the four-bar linkage are free to rotate about the frame 10. This permits the footplate 35 to move further toward the user, giving the user a full range of motion for the squat press exercise. The user lowers the footplate down toward her chest and then presses the footplate up with her feet. As the footplate is pressed away from the user support 100, the four-bar linkage and the lever 36 rotate, causing any weight plates mounted on the posts 37 to rotate up in an arcuate path 200 (see FIG. 2) having a center at the pivot 31*a*. As the footplate moves toward the end of the range of motion away from the user support 100, the movement of the weight plate has a larger vertical component (i.e., the weight plates move further up for a corresponding distance of footplate displacement than when the footplate is near the user support). The arcuate path causes the weight of the plates to provide a gradually increasing resistance to the movement of the footplate. In particular, the weight plates' movement in an arcuate path creates a sinusoidal increasing resistance to the extension of the user's legs.

When the user has completed the desired number of repetitions, she pulls up on the stop release 20, pulling the stop 23 into the path of the lever 36, and lowers the footplate 35 partially so the lever rests on the bumpers 24 of the stop, preventing the footplate from lowering any further. If the user lowers the footplate without engaging the stop, the lever will come to rest against the pad 19.

The foregoing description of an embodiment of the invention is in no way intended as a limit to the scope of the invention which is defined by the following claims:

I claim:

1. A squat press apparatus comprising:

a frame;

a user support mounted to the frame;

a four-bar linkage having first, second, third and fourth consecutive links, the first link being mounted directly to the frame;

a footplate mounted directly to the third link;

a lever rotatably mounted to the frame and operably engaged to the four-bar linkage such that the lever rotates with the four-bar linkage; and at least one post mounted to the lever adapted to support a removable weight, wherein said removable weight biases said footplate towards said user support when disposed on said at least one post.

2. The apparatus of claim 1 wherein the lever is rigidly mounted to the four-bar linkage.

3. The apparatus of claim 2 wherein the lever has a substantially triangular cross-section with an apex and a base.

4. The apparatus of claim 3 wherein the apex of the lever is mounted to the four-bar linkage.

5. The apparatus of claim 3 wherein the at least one post is mounted to the base of the lever.

6. The apparatus of claim 2 wherein the lever extends from the four-bar linkage toward the user support.

7. The apparatus of claim 1 wherein the at least one post is disposed outside of the frame.

8. The apparatus of claim 1 wherein said at least one post comprises at least two posts mounted to the lever which posts are disposed symmetrically about the frame.

9. The apparatus of claim 1 wherein the user support is disposed at an elevation below the footplate.

10. The apparatus of claim 9 wherein the user support comprises a seat and a backrest.

11. The apparatus of claim 1 further comprising a means for limiting the range of motion of the four-bar linkage.

12. A squat press apparatus comprising:

a frame having a first end and a second end;

a user support mounted to the frame at the first end;

an upper link pivotally connected to the frame;

a beam pivotally connected to the frame;

a mount pivotally connected directly to the beam and pivotally mounted directly to the upper link;

a footplate mounted directly to the mount;

a lever mounted to the beam; and at least one post mounted to the lever and adapted to support a removable weight, wherein said removable weight biases said footplate towards said user support when disposed on said at least one post.

13. The apparatus of claim 12 wherein the beam is mounted to the frame at a pivot and wherein the pivot is disposed at a lower elevation than the footplate.

14. The apparatus of claim 12 wherein the user support comprises a seat and a backrest.

15. The apparatus of claim 12 wherein the lever extends from the beam toward the user support.

16. The apparatus of claim 12 further comprising a lower link rigidly mounted to the frame wherein the beam and the upper link are rotatably mounted to the lower link.

17. The apparatus of claim 12 further comprising a stop rotatably mounted to the frame at the second end.

18. The apparatus of claim 17 further comprising a stop release operably engaged to the stop.

19. The apparatus of claim 12 wherein the upper link is chevron-shaped.

20. The apparatus of claim 12 further comprising non-slipping material mounted to the footplate.

21. The apparatus of claim 12 wherein the user support is at a lower elevation than the footplate.

22. The apparatus of claim 12 wherein the at least one post is disposed outside of the frame.

23. The apparatus of claim 12 wherein the beam is connected to the frame at a first pivot, the mount is connected to the beam at a second pivot, the mount is connected to the upper link at a third pivot and the upper link is connected to the frame at a fourth pivot.

24. The apparatus of claim 23 wherein the distance between the first and second pivots is greater than the distance between the third and fourth pivots.

25. A squat press apparatus comprising:

a frame having a first and a second end;

a user support mounted to the frame at the first end;

a lower link having first and second ends, fixedly mounted directly to the second end of the frame;

an upper link having first and second ends, the first end of the upper link pivotally mounted to the first end of the lower link;

a beam having first and second ends, the first end of the beam pivotally mounted to the second end of the lower link;

a mount having first and second ends, the first end of the mount pivotally mounted to the second end of the beam and the second end of the mount pivotally mounted to the second end of the upper link;

a footplate mounted directly to the mount;

a lever mounted to the beam, wherein the lever extends from the beam toward the user support; and a post mounted to the lever adapted to support a removable weight distal to the beam.

26. A squat press apparatus comprising:

a frame having a first and a second end;

a user support mounted to the frame at the first end;

a four-bar linkage having first, second, third and fourth consecutive links, the first link being mounted directly to the second end of the frame;

a footplate mounted directly to the third link;

a lever mounted to the second link, wherein the lever extends from the second link toward the user support; and a post mounted to the lever adapted to support a removable weight.

27. A method for exercising the legs of a user on a machine having a frame, a user support, a four-bar linkage mounted to the frame, a footplate mounted directly to the four-bar linkage and a lever operably engaged to the four-bar linkage, comprising the steps of:

mounting at least one weight plate to the lever so as to bias said footplate towards said user support;

positioning the user on the user support;

displacing the footplate away from the user support with the user's feet wherein the displacement of the footplate causes the four-bar linkage to rotate which, in turn, causes the lever to rotate about the frame; and resisting the rotation of the lever with the gravitational force on the at least one weight plate.

28. The method of claim 27 further comprising the step of releasing a stop which is releasably engaged to the lever.

29. The method of claim 27 wherein the user support comprises a backrest, further comprising the step of rotating the backrest.

30. A method of a user performing a squat press on an apparatus having a frame, a user support, a four-bar linkage mounted to the frame and a displaceable footplate mounted directly to the four-bar linkage, comprising:

loading at least one weight plate onto a lever so as to bias said footplate towards said user support;

positioning the user on the user support;

displacing the footplate away from the user support by means of the user's feet such that the angular orientation of the footplate with respect to the user's lower leg is maintained substantially constant;

wherein the lever is operably engaged to the footplate such that the step of displacing the footplate causes the lever to rotate about the frame which, in turn, causes the weight plate to move in an arcuate path.

31. The method of claim 30 further comprising the step of releasing a stop which is releasably engaged to the lever.

32. The method of claim 30 further comprising the steps of sequentially lowering the footplate toward the user support and then displacing the footplate away from the user support.

33. The method of claim 30 further comprising the step of engaging a stop to limit movement of the lever toward the user support.

* * * * *